United States Patent [19]

Masumoto et al.

[11] Patent Number: 4,735,864

[45] Date of Patent: Apr. 5, 1988

[54] AMORPHOUS METAL FILAMENTS AND PROCESS FOR PRODUCING SAME

[75] Inventors: Tsuyoshi Masumoto; Akihisa Inoue, both of Miyagi; Michiaki Hagiwara, Kyoto, all of Japan

[73] Assignee: Tsuyoshi Masumoto and Unitika, Limited, Japan

[21] Appl. No.: 33,871

[22] Filed: Apr. 2, 1987

Related U.S. Application Data

[60] Continuation of Ser. No. 719,790, Apr. 4, 1985, abandoned, which is a division of Ser. No. 597,576, Apr. 9, 1984, Pat. No. 4,523,621, which is a continuation of Ser. No. 254,714, Apr. 16, 1981, abandoned.

[30] Foreign Application Priority Data

| | | | |
|---|---|---|---|
| Apr. 17, 1980 | [JP] | Japan | 55-50998 |
| Sep. 16, 1980 | [JP] | Japan | 55-128219 |
| Feb. 10, 1981 | [JP] | Japan | 56-18589 |

[51] Int. Cl.[4] ..... H01F 1/00

[52] U.S. Cl. ..... 428/606; 148/403; 148/304

[58] Field of Search ..... 428/606, 611; 148/403, 148/304, 315, 442

[56] References Cited

U.S. PATENT DOCUMENTS

| | | | |
|---|---|---|---|
| 3,856,513 | 12/1974 | Chen et al. | 75/122 |
| 3,986,867 | 10/1976 | Masumoto et al. | 75/126 A |
| 4,030,892 | 6/1977 | Mendelsohn | 148/31.55 |
| 4,052,201 | 10/1977 | Polk et al. | 75/124 |
| 4,056,411 | 11/1977 | Chen et al. | 148/121 |
| 4,081,298 | 3/1978 | Mendelsohn et al. | 148/121 |
| 4,126,287 | 11/1978 | Mendelsohn et al. | 75/123 B |
| 4,137,075 | 1/1979 | Ray et al. | 75/123 B |
| 4,140,525 | 2/1979 | Ray | 75/126 C |
| 4,144,058 | 3/1979 | Chen et al. | 75/123 K |
| 4,318,738 | 3/1982 | Masumoto et al. | 75/123 B |
| 4,439,236 | 3/1984 | Ray | 75/126 P |
| 4,482,400 | 11/1984 | O'Handley | 148/403 |

FOREIGN PATENT DOCUMENTS

| | | |
|---|---|---|
| 51-23438 | 2/1976 | Japan . |
| 2343876 | 2/1976 | Japan . |

*Primary Examiner*—John P. Sheehan

*Attorney, Agent, or Firm*—Sughrue, Mion, Zinn, Macpeak, and Seas

[57] ABSTRACT

Amorphous metal filaments having a substantially circular cross-section comprising an alloy containing Fe as a main component, and a process for producing such amorphous metal filaments, are described; the process comprises jetting a molten alloy having amorphism forming ability into a revolving body containing a cooling liquid from a spinning nozzle to form a solidified filament by cooling, and continuously winding the filament on the inner wall of said revolving body by means of the centrifugal force of said revolving body, wherein the circumferential rate of revolution of said revolving body is equal to or higher than the rate of jetting of molten metal from the spinning nozzle. These metal filaments have good corrosion resistance, toughness, and high magnetic permeability and are very useful in various industrial applications, such as electric and electronic parts, materials for reinforcement, and fiber materials.

7 Claims, 1 Drawing Sheet

AMORPHOUS METAL FILAMENTS AND PROCESS FOR PRODUCING SAME

This is a continuation of application Ser. No. 719,790, filed Apr. 4, 1985 and now abandoned, which is a divisional of application Ser. No. 597,576, filed Apr. 9, 1984, now U.S. Pat. No. 4,523,621, which is a continuation of application Ser. No. 254,714, filed Apr. 16, 1981 and now abandoned.

FIELD OF THE INVENTION

The present invention relates to amorphous metal filaments having a round cross-section and a process for producing the same.

BACKGROUND OF THE INVENTION

A process for producing metal filaments directly from molten metal can be used for producing cheap metal filaments. Further, if the resulting metal filaments have an amorphous structure, they have a number of excellent chemical, electrical, and physical characteristics, and they have good applicability in many fields, such as electric and electronic parts, materials for reinforcement and fiber materials, etc. Particularly in the case of amorphous alloys, it is possible to emphasize the above described characteristics as compared with the prior crystalline alloys or crystalline metals, when a suitable alloy composition is selected. Particularly, from the viewpoint of corrosion resistance, stiffness and high magnetic permeability, it has been desired to develop new materials having desirable characteristics which have not been known heretofore. Amorphous metals have been broadly described already in *Nippon Kinzoku Gakkai Kaiho,* No. 3 Vol. 15 (1976); *Science* No. 8, 1978; *Proceedings of the 2nd International Conference,* edited by N. J. Grant and B. C. Giessen, Vol. II, Elsenier Sequoia S.A., Lausanne 1976; etc. Concerning amorphous metals having such desired excellent characteristics, it has been highly desired to produce high quality filaments having a round cross-section by a simple melt spinning process.

Heretofore, the production of amorphous metal filaments having a round cross-section by spinning molten metal directly into a cooling liquid to solidify the alloy filament has been limited to the case of alloys having a critical cooling rate of about $10^3$ ° C./second, such as $Pd_{77.5}$-$Cu_6$-$Si_{16.5}$ alloy (numerals represent atomic %) (*Scripta Metallugica,* Vol. 13, 1979, pages 463–467). The difficulty of formation of the amorphous alloy highly depends upon the kind and the composition of metals. It has been believed that amorphous metal is difficult to produce from Fe, Ni, and Co alloys, which would be particularly useful as practical materials for a number of uses, because they have a critical cooling rate in the range of about $10^5$–$10^6$ ° C./second, and the cooling rate thereof in a cooling liquid is low. Thus, heretofore, in order to produce amorphous Fe, Ni, and Co alloys, a gun process, a piston-umbel process, a roll quenching process, a centrifugal quenching process, and a plasma-jet process, etc., which have high cooling rates, have been used. However, according to the above described processes, excepting the roll quenching process and the centrifugal quenching process, only plates having an unsettled shape can be obtained, i.e., thin pieces having no a definite shape such as a wire and a ribbon and a reproducibility in the production thereof cannot be obtained. In the roll quenching process and the centrifugal quenching process, only ribbon-shaped products having a fixed shape are obtained. Accordingly, such products can be used for only limited specific purposes because of having a flat shape. Processes for producing ribbon-shaped amorphous metal filaments have been described in the above described documents concerning amorphous alloys, as well as in Japanese Patent Application (OPI) Nos. 91014/74 (U.S. Pat. No. 3,856,513), 125228/78, 125229/78, 88219/77, 101203/75, 4017/76, 109221/76 (DT Pat. No. 2606581, FR Pat. No. 2301605), 12719/78, 12720/78, 133826/77 (DT Pat. No. 2719710, FR Pat. No. 2350159) and 88220/77 (The term "OPI" as used herein refers to a "published unexamined Japanese patent application".), and Japanese Patent Publication No. 50727/77, etc. Since these prior processes for producing amorphous metal filaments are based on a principle of jetting molten metal onto the surface of a quenching object, it has been unavoidable to flatten on the contacting surface and, consequently, it has been impossible to obtain filaments having a round cross-section. An attempt of producing filaments having a round cross-section by jetting molten metal to a roll surface having round cavities has been made, but the success in production has been very limited because the molten metal can not be perfectly jetted into the very fine cavities.

On the other hand, a number of processes have been developed in order to obtain metal filaments having a round cross-section directly from molten metal. For instance, there is a process similar to the so-called melt spinning process for producing synthetic fibers in a mass production, wherein a very unstable metal stream having a low viscosity is solidified by cooling while maintaining a continuous stream. For example, in Japanese Patent Publication No. 24013/70, a process has been proposed which comprises spinning into a gas atmosphere capable of reacting with metal to form an oxide or nitride film on the molten filament surface, as a stabilization means for solidifying with cooling. However, when this process is examined in detail, it is found to be very difficult to stabilize the molten metal by mere formation of such a film to the same degree as exists in the solid state. Moreover, this process is useful only for specific metals which form an oxide or nitride film.

Further, Japanese Patent Publication No. 25374/69 has disclosed a very useful means for cooling molten metal wherein fusing agent particles are sprayed to achieve a state of suspension in an inert gas in an ionizing zone by corona discharging, and the molten metal is cooled to solidify it by utilizing the latent heat of the fusing agent. With respect to similar cooling processes, processes which comprise spinning molten metal in foams or air bubbles to solidify by cooling have been proposed in, for example, Japanese Patent Applications (OPI) Nos. 56560/73 and 71359/73. These processes, however, have a low cooling rate and chemical or electrostatic stabilization of the spinning stream is insufficient.

As another process, there is a composite spinning process for metal which utilizes spinnability of glass described in *Kasen Geppo,* No. 7, 1974, page 61. This composite spinning process is, however, effective for only the case of a specific combination concerning melt viscosity of glass and melting temperature of metal, and it can not be used for all metals. In addition, structures of the melting part and the spinning nozzle part are complicated, and a high accuracy is required because it involves composite spinning. Moreover, in the case of using these as metal filaments, it is necessary to remove the outer glass film, by which the cost of production becomes very high. Accordingly, this composite spinning process has many problems limiting industrial practice thereof.

Further, a process for producing metal filaments which comprises jetting spun molten metal in a cooling liquid flowing in parallel to the direction of jetting has been proposed as is shown in Japanese Patent Application (OPI) No. 1335820/74. However, in this process, since the spun molten metal and the cooling liquid run at the same rate as parallel streams, high cooling ability is insufficient. Particularly, the cooling liquid and the liquid level thereof are difficult to maintain stably, because of collision with the spun molten metal, boiling of the cooling medium, and convection currents, and consequently high quality amorphous metal filaments having a round cross-section can not be obtained by this process. Moreover, it is industrially difficult to directly continuously wind the solidified filaments.

Further, a process for producing continuous fine filaments of lead having a round cross-section which comprises putting water in a revolving drum to form a water membrane on the inner wall of the drum be centrifugal force, and jetting molten lead in the water membrane has been reported in 1978 in *Nippon Kinzoku Gakkai,* autumn convention, (83rd, at Toyama), lecture manuscript No. 331. However, this process can be adopted only for metals having good spinnability, such as lead, and it is impossible to form continuous fine filaments of amorphous alloy under the conditions that the jetting rate is higher than revolving rate of the drum, which is the essential condition for practicing the process. In addition, the fine filaments of lead resulting in this process can not be practically used because they are not amorphous, the degree of roundness is inferior, and the size of the cross sectional area in the longitudinal direction is not uniform.

Moreover, amorphous metal wires of alloy consisting of $Fe_{38}Ni_{39}P_{14}B_6Al_3$ (numerals are % by weight; Fe is 28 atomic %) have been described in Japanese Patent Application (OPI) No. 135820/74. However, these amorphous metal wires are expensive because of having the high Ni content.

SUMMARY OF THE INVENTION

An object of the present invention is to provide amorphous metal filaments having a round (i.e., substantially circular) cross-section which are inexpensive have good corrosion resistance, toughness, and high magnetic permeability, and are useful in various industrial applications such as electric and electronic parts, materials for reinforcement, fiber materials, etc. Another object of the present invention is to provide a process for producing economically and easily the above described filaments.

As a result of extensive studies for the purpose of attaining the above described objects, according to the present invention it has been found that high quality amorphous metal filaments having a round cross-section can be obtained when an alloy having an amorphism forming ability is used and cooled to solidify the alloy filament simultaneously with winding the filament in a revolving body under specific conditions regarding the circumferential rate of rotation of the revolving body, and thus the present invention has been completed.

Therefore, the present invention provides an amorphous metal filament having a round cross-section comprising an alloy containing Fe as a main component, and a process for producing amorphous metal filaments having a round cross-section comprising jetting a molten alloy having amorphism forming ability in a revolving body containing a cooling liquid from a spinning nozzle to form a solidified filament by cooling, and continuously winding the filament on the inner wall of said revolving body by means of the centrifugal force of said revolving body, wherein the circumferential rate of revolution (also referred to herein simply as the "revolving rate") of said revolving body is equal to or higher than the rate of a jetting of the molten metal (also referred to herein simply as the "jetting rate") from the spinning nozzle.

The amorphous metal filaments having a round cross-section of the present invention can be easily obtained by an economical production process, and are economical and have good corrosion resistance, toughness, and high magnetic permeability, and are very useful in various industrial applications, such as electric and electronic parts, material for reinforcement, fiber materials, and so forth.

DETAILED DESCRIPTION OF THE INVENTION

Figure 1:
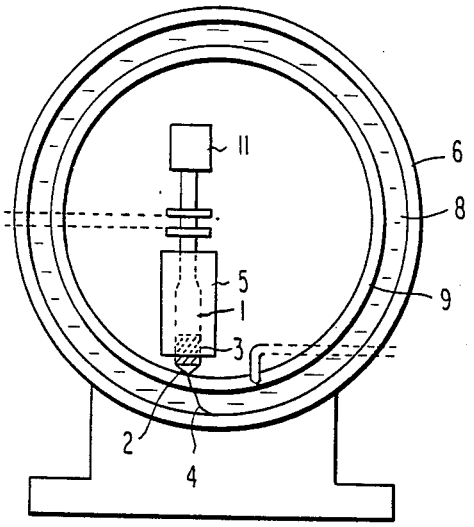
FIG. 1 and FIG. 2 are schematic plans of lateral apparatus which show an embodiment of the present invention.

The alloy containing Fe as a main component used in the present invention means alloys in which the Fe element is contained as the largest amount (atomic %) of a single component of the alloy components. Most amorphous alloys known hitherto consist of metal elements and semimetals contributing to amorphism. As the semimetals, P, C, Si, B and Ge, etc. have been used. When the fine filament forming ability of metal elements is examined for the case of solidification by rapidly cooling the molten metal by introducing it into a revolving cooling liquid using alloys wherein various semimetals are combined with Fe, Ni, and Co as the important metal elements desired for practical materials, it has been found that Ni based alloys have inferior filament forming ability, because they become nearly spherical shots in the revolving cooling liquid. On the other hand, Fe based alloys, which are also the most economical, have excellent fine filament forming ability. Co based alloys have fine filament forming ability slightly inferior to Fe to the Fe based alloys. The term "fine filament forming ability" means being capable of forming a uniform continuous filament having a round cross-section, the size of which is uniform in the longitudinal direction, when a molten metal stream is spun in the revolving cooling liquid to form a solidified filament by cooling. To explain this in greater detail, it is noted that it has been well known that a uniform amorphous continuous flat filament can very easily be obtained from a Ni-Si-B alloy, as a typical Ni based alloy, by the centrifugal quenching process. However, if such a molten metal alloy stream is spun in the revolving cooling liquid according to the present invention to solidify it by rapidly cooling, a continuous filament can not be obtained at all, and instead spherical shots are obtained.

Further, if a $Pd_{82}$-$Si_{18}$ (The numerals are atomic %.) alloy which has a low critical cooling rate of $1.8\times10^3$ ° C./second is rapidly cooled to solidify it in the revolving liquid, it also results in spherical shots being obtained. A Pd-Cu-Si alloy prepared by adding about 6 atomic % of Cu to the above described alloy has excellent fine filament forming ability, from which a very uniform amorphous continuous filament having a round cross-section can be obtained. However, this alloy is very expensive.

In the following, a study of the relation of semi-metal contributing to amorphism of alloys and the fine filament forming ability is described. The fine filament forming ability in the revolving cooling liquid surprisingly varies according to the kind and the combination of semimetal elements. For example, when the fine filament forming ability in the revolving cooling liquid is studied in comparisons with alloys consisting of Fe metal element having an excellent fine filament forming ability, as described above, and semimetals, the order is found to be as follows: Fe-Si-B≧Fe-P-Si>Fe-P-C>>Fe-C-Si>>Fe-P-B>Fe-C-B. Furthermore, Co-Si-B alloy has excellent fine filament forming ability. These results indicate that the fine filament forming ability significantly varies according to the composition of the alloy. Though the reason is not completely clear at present, the observed fine filament forming ability is believed to be influenced by viscosity of the molten metal stream, surface tension, cooling rate, and physical and chemical functions with the revolving cooling liquid.

Moreover, the amorphism forming ability also greatly depends upon the kind of semimetals added, similarly to the case of fine filament forming ability. Generally, the amorphism forming ability order is found to be as follows: Fe-Si-B≧Fe-P-C>Fe-P-Si. Furthermore, Co-Si-B alloy has high amorphism forming ability. The term "amorphism forming ability" means being capable of forming an amorphous structure at a cooling rate in the range of about $10^7$ ° C./second or less in the case of solidification by cooling the molten alloys. Generally, the amorphous structure formed is determined by an optical microscope, diffraction of X-rays, electron microscope, etc.

Accordingly, as practical alloys containing Fe as a main component used in the present invention, Fe-Si-B and Fe-P-C alloys are preferred. Particularly preferred amounts of Si and B in the Fe-Si-B alloy are 17.5 atomic % or less of Si and from 5 to 22.5 atomic % B wherein the sum of Si and B is from 20 to 32.5 atomic %. In this Fe-Si-B alloy, at least one metal other than Fe, Si and B can be added in the ranges of 30 atomic % or less. If a part of Fe metal element is substituted by 30 atomic % or less of Co or 20 atomic % or less of Ni, the electromagnetic property, and the blocking and contamination of the nozzle can be improved without substantially changing the amorphism forming ability and the fine filament forming ability. If a part of Fe metal element is substituted by Cr, Mo, Nb, Ta, V, W, Zr, Ti, Be, Mn, Sn, or Hf, the heat resistance and strength can be improved. Further, the corrosion resistance can be improved by the addition of Cr, Mo, Ti, Al, Pd, V, W, Pt, Cu, Zr, Cd, As or Sb. In this case, it is possible to obtain high quality continuous amorphous metal filaments having a round cross-section without deteriorating the amorphism forming ability and the fine filament forming ability, if, for example, the Cr and Mo are 10 atomic % or less, respectively, or Nb and Ta are 10 atomic % or less, respectively, or V, W, Zr, Ti, Be, Mn, Sn, Hf, Ti, Al, Pd, Pt, Cu, Cd, As and Sb are 5 atomic % or less, respectively. Alloys wherein at least one selected from the group consisting of Bi, P, C, Ge and S is contained in the total amount of 5 atomic % or less may also be used, if such elements do not significantly deteriorate the amorphism-forming ability and the fine filament forming ability. In the case of using the Fe-Si-B alloy, it is preferred to select the opening diameter Dn (μm) of the spinning nozzle such that it satisfies the formula (I)

$$Dn \leqq 270-9(|Si-10|)-25(|B+Si/2-20|) \quad (I)$$

The diameter of filaments, Df (μm), obtained using this spinning nozzle is equal to or slightly smaller than the opening diameter Dn (μm) of the nozzle.

Preferred amounts of P and C in the Fe-P-C alloy are from 5 to 20 atomic % P and 20 atomic % or less of C, preferably 5 to 20 atomic % of C, wherein the sum of P and C is from 17.5 to 30 atomic %. In this Fe-P-C alloy, at least one metal other than Fe, P and C can be added in the ranges of 30 atomic % or less. If a part of Fe metal element is substituted by 30 atomic % or less of Co or 20 atomic % or less of Ni, electromagnetic properties can be improved without causing blocking or deteriorating the life of the nozzle, oxidation resistance, corrosion resistance, etc. If a part of the Fe is substituted by Cr, W, Mo, Ta, Nb, Mn, V, Al, Zr, Ge, Cu, Pd, Hf, Sn, Ti, Pt, Cd, As, or Sb, the corrosion resistance, oxidation resistance, heat resistance and strength can be improved, as above-mentioned in the case of Fe-Si-B alloy. In this case, it is possible to obtain high quality continuous amorphous metal filaments having round cross-sections without significantly changing the amorphism forming ability and the fine filament forming ability, if Cr, W, Mo, Ta and Nb are 10 atomic % or less, respectively or Mn, V, Al, Zr, Ge, Cu, Pd, Hf, Sn, Ti, Pt, Cd, As, and Sb are 5 atomic % or less, respectively. Alloys wherein at least one selected from other elements such as Si, B, Bi or S, etc. is contained in the total amount of 5 atomic % or less may also be used, if such elements do not significantly deteriorate the amorphism-forming ability and the fine filament forming ability. In the case of using the Fe-P-C alloy, it is preferred to select the opening diameter Dn (μm) of the spinning nozzle such that it satisfies the formula (II)

$$Dn \leqq 250-16(|P-12.5|)-25(|23.5-P-C|) \quad (II)$$

The diameter of filaments Df (μm) obtained using this spinning nozzle is equal to or slightly smaller than the opening diameter Dn (μm) of the nozzle.

The cooling liquid used in the present invention includes, for example, pure liquids, solutions, and emulsions, etc., which are sufficient for use if they form a stabilized surface by reacting with the spun molten metal or if they are chemically inert to the spun molten metal. In order to obtain uniform amorphous continuous filaments having a round cross-section, it is preferred to select a cooling liquid having a suitable cooling rate and, at the same time, it is desirable that the cooling liquid and the liquid layer are stabilized and not disturbed. Particularly, it is preferred to use water at room temperature or less, or an aqueous solution of electrolyte in which metal salts are dissolved. Generally, the step which comprises rapidly cooling the molten metal by bringing it into contact with the cooling liquid is divided into three stages. In the first stage, a vapor layer of the cooling liquid covers the whole of the metal and cooling rate is relatively low, because cooling is carried out by radiation through the vapor layer. In the second stage, the vapor layer is broken, vigorous boiling continuously occurs, and the cooling rate is at its highest because the heat is dissipated as evaporation heat. In the third stage, the boiling is stopped and the cooling rate again becomes low, because the cooling is carried out by conduction and convection. Particularly, in order to carry out rapid cooling, it is desirable that (a) the cooling liquid be selected such that the first stage is shortened as much as possible so as to quickly reach to the second stage and (b) the cooling liquid or the molten metal to be cooled is allowed to quickly move by an artificial means of revolving a cooling liquid to decompose the vapor layer in the first stage, by which cooling of the second stage type is quickly carried out. This will be understood with freference to an example, wherein it was found that the cooling rate of vigorously stirred water is about 4 times that of standing water. Thus, in order to provide an increased cooling rate, it is desirable that the cooling liquid have a high boiling point, a large latent heat of vaporization, and good fluidity so that the vapor and air bubbles are easily dissipated. It is also desirable that it is economical and chemically stable. Further, in order to break the vapor layer in the first stage as quickly as possible (to initiate the cooling of the second stage) and to keep the cooling liquid and the liquid surface in a stabilized state, it is preferred to place the cooling liquid in a revolving body. In order to increase the cooling rate, it is desirable to use a cooling liquid having a high specific heat, to increase the rate of revolution of the revolving body, to increase the rate of the jetting of the molten alloy from the spinning nozzle, to widen an introduction angle of the spun molten alloy to the liquid surface of the cooling liquid, and to shorten the distance between the spinning nozzle and the liquid surface of the cooling liquid. The introduction angle of the spun molten alloy to the liquid surface of the cooling liquid refers to an angle formed between a tangent line at a point where the spun molten alloy first contacts the liquid surface of the cooling liquid and the spun molten alloy, i.e., an angle formed between the surface of the cooling liquid and the jet of molten alloy.

Figure 2:
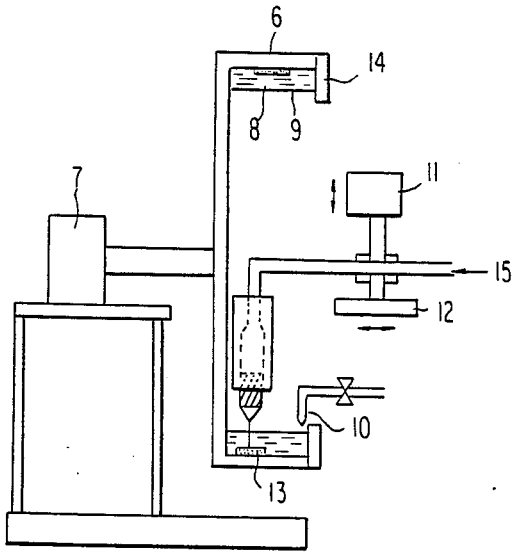
Figure 3:
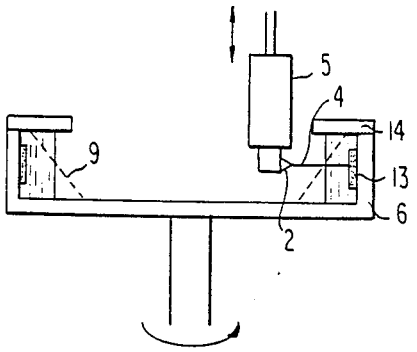
FIG. 3 is a schematic plan of a vertical apparatus which shows an embodiment of the present invention.

In the following, the present invention is described in greater detail by reference to the drawings. FIGS. 1, 2, and 3 show apparatus illustrating different embodiments of the present invention. FIG. 1 and FIG. 2 are schematic plans of lateral apparatus, and FIG. 3 is a schematic plan of a vertical apparatus. In these figures, 1 is a crucible into which alloy 3, to be subjected to melt spinning, is placed. The crucible 1 is composed of a suitable heat resisting material, for example, quartz, zirconia, alumina, boron nitride, or other ceramics. This crucible 1 has a nozzle 2 having one or more spinning openings, which openings are of approximately the same size as the desired diameter of the metal filaments. The nozzle is composed of a heat resisting material similar to the material forming the crucible 1, which includes ceramics such as quartz, zirconia, alumina, or boron nitride, etc., or artificial ruby, sapphire, etc. 5 is a heating furnace for heating to melt the metal 3 to be subjected to melt spinning. 6 is a revolving drum which revolves by means of a driving motor 7. 8 is a cooling liquid which forms a liquid surface 9 of the cooling liquid on the inner side of the revolving drum 6. 10 is a pipe for feeding or discharging the cooling liquid 8. Selection of the kind of the cooling liquid 8 and temperature thereof is determined based on the heat capacity of the molten metal 4. The heat capacity of the molten metal increases in proportion to its temperature, specific heat, latent heat of fusion, and cross-sectional area. It is desirable that the cooling liquid have a lower temperature, and that the specific heat, density, heat of evaporation and thermal conductivity, of the cooling liquid be higher, as the heat capacity of the molten metal 4 increases. Other desirable properties of the cooling liquid are low viscosity, so as to minimize separation of the molten alloy 4 in the liquid medium, incombustibility, and low cost. As a typical cooling liquid, water at a room temperature or less is desirably used. However, since high quality amorphous metal filaments can more easily be obtained when the cooling rate is high, it is preferred to use an aqueous solution of electrolyte cooled to room temperature or less, for example, an aqueous solution of 10–25% by weight sodium chloride, an aqueous solution of 5–15% by weight sodium hydroxide, an aqueous solution of 10–25% by weight of magnesium chloride and an aqueous solution of 50% by weight of zinc chloride. The introduction angle of the molten alloy 4 to the liquid surface 9 and the revolution of the revolving drum 6 may be in any direction. The rate of revolution of the revolving drum 6 has a large influence upon the fine filament forming ability, and it is necessary that the circumferential rate of the revolving rate is equal to or higher than the rate of jetting of the molten alloy 4 from the spinning nozzle. It is particularly preferred that the circumferential rate of revolution of the revolving drum 6 is from 5 to 30% higher than the rate of jetting of the molten alloy 4 from the spinning nozzle. Further, the circumferential rate of revolution of the revolving drum 6 is preferred to be at least 300 m/minute. The introduction angle is preferred to be at least 20°. Further, it is preferred that the distance between the spinning nozzle 2 and the liquid surface 9 of the cooling liquid be shortened to the smallest distance possible without causing disturbance, breaking, or cutting of the spun molten alloy 4, and it is particularly desirably 10 mm or less. 11 is an air piston for supporting and moving the crucible 1 up and down. 12 is a shaking device for moving crucible 1 at a fixed rate to continuously and regularly wind the solidified metal filaments on the inner wall of the revolving drum 6. FIG. 3 shows a vertical apparatus which has the same structure as in FIG. 1 and FIG. 2. The advantages of this apparatus include the facts that it is not necessary to feed and discharge the cooling liquid, and that a uniform liquid surface of the cooling liquid can be formed even if a very low rate of revolution is used. In the other hand, if the rate of revolution is varied, the introduction angle to the liquid surface of the cooling liquid varies (in case of low speed revolution, it moves to a liquid surface shown as a dotted line in the drawing). Further, it is necessary to process (bend) the spinning nozzle so that the spun molten alloy becomes vertical to the liquid surface of the cooling liquid. 14 is a shielding plate removable from the revolving drum, which is preferred to be transparent so that the state of spinning and winding can be well observed. The alloy 3 is first introduced into the crucible 1 from an inlet by means of gas stream, etc. and it is then heated to fuse in a position of the heating furnace 5. At the same time, the revolving drum 6 is revolved at a desired rate by the driving motor 7, and the cooling liquid is fed to the inside of the revolving drum through a feed pipe 10 for the cooling liquid.

Then the spinning nozzle 2 is set down by the shaking device 12 and the air piston 11 so as to face to the liquid surface 9 of the cooling liquid at a position shown in FIGS. 1 and 2, while gas pressure is applied to the alloy 3, by which the molten alloy 4 is jetted towards the liquid surface 9 of the cooling liquid. In order to prevent oxidation of the alloy 3, an inert gas 15, for example, an argon gas, is introduced into the crucible 1 to make an inert atmosphere. The metal introduced into the liquid surface 9 of the cooling liquid runs through the cooling liquid 8 based on the direction of jetting, the revolving direction of the revolving drum, and a centrifugal force, forms a solidified filament by cooling, and is wound regularly on the inner wall of the revolving drum 6 or on the inside of accumulated metal filaments 13 which were already coagulated by cooling, by the shaking device 12. After the conclusion of the spinning, the end of the discharge pipe 10 for the cooling liquid is inserted into the cooling liquid 8 to discharge the cooling liquid. The revolution of the revolving drum 6 is stopped, the shielding plate 14 is taken off, and high quality amorphous metal filaments 13 having a round cross-section accumulated on the inner wall of the revolving drum 6 are removed. The filaments in this state can be used directly as the product. It is of course possible to rewind only in the amount required according to the amount used.

The metal filament having a round cross-section in the present invention means that having a degree of perfect circle of 0.7 or more, which is the ratio R min/R max, wherein R max represents the longest diameter of a cross-section and R min represents the shortest diameter of the same cross-section.

According to the present invention, amorphous metal filaments having a round cross-section can be obtained easily by an economical process, and the resulting filaments are cheap and have corrosion resistance, toughness and high magnetic permeability, and they are remarkably useful as various industrial materials such as electric and electronic parts, materials for reinforcement and fiber materials, etc.

In the following, the present invention is illustrated in greater detail by reference to examples. The alloys used in the examples are an alloy prepared by heating metal elements having a purity of 99.99 wt.% under atmosphere of argon gas in electric furnace while stirring sufficiently to fuse the metals. In the examples, the rate of jetting of the molten alloy from the spinning nozzle was calculated by measuring a weight of accumulated metal jetted over a definite period of time. The determination of unevenness of size of the filament in the longitudinal direction was carried out as follows. 10 spots in a 10 m sample are selected, and the diameter each of them was measured, respectively, to calculate an average diameter. A difference between the maximum diameter and the minimum diameter is divided by the average diameter and the resulted number is increased a hundredfold. In examples, whether the filament has an amorphous structure or a crystalline structure was determined by diffraction of X-rays using Cu-K exposure or Fe-K exposure. Further, the numerals which show ratios of alloy compositions in the Examples are all atomic %.

EXAMPLE 1

Spinning was carried out under the following conditions, using an apparatus equipped with a lateral revolving drum having an inside diameter of 500 mm shown in FIG. 1 and FIG. 2.

Composition of alloy: $Fe_{68}$-$Co_{10}$-$Si_{18}$-$B_4$
Fusing temperature: 1300° C. (in argon gas atmosphere)
Diameter of nozzle opening: 100 μm (made of ruby)
Jetting rate: 500 m/min. (using argon gas pressure)
Revolving rate of drum: 550 m/min.
Cooling liquid in revolving drum: 20% aqueous solution of sodium chloride at −15° C.
Thickness of cooling layer in revolving drum: 25 mm
Introduction angle of jetting metal to cooling layer: 75°
Distance between nozzle and liquid surface of cooling liquid: 3 mm The jetted molten alloy was rapidly solidified in the cooling layer and continuously accumulated on the inner wall of the revolving drum by a centrifugal force. The resulting filament was an amorphous metal filament having a round cross-section of a diameter of 90 μm which had a degree of perfect circle of 0.80.

EXAMPLE 2

When spinning was carried out by the same process as that in Example 1 except that the composition of alloy was $Fe_{75}$-$P_{7.5}$-$B_{17.5}$ and the diameter of nozzle opening used was 50 μm, an amorphous metal filament having a round cross-section which had a degree of perfect circle of 0.75, a diameter of 40 μm and unevenness of size in the longitudinal direction of 10.0% was continuously obtained on the inner wall of the drum.

EXAMPLES 3–33

Spinning was carried out under the following conditions using an apparatus equipped with a lateral revolving drum having an inside diameter of 700 mm shown in FIG. 1 and FIG. 2.

Composition of alloy: Fe-Si-B alloy described in Table 1
Fusing temperature: A temperature 70° C. higher than a melting point of each alloy (in argon atmosphere)
Diameter of nozzle opening: 180 μm
Jetting rate: 400 m/min. (using argon gas pressure)
Revolving rate of drum: 440 m/min.
Cooling liquid in revolving drum: Water at 5° C.
Thickness of cooling liquid layer in revolving drum: 20 mm
Introduction angle of jetting metal to cooling liquid layer: 80°
Distance between nozzle and liquid surface: 5 mm In the case of all compositions of alloy, the jetted molten alloy was rapidly solidified in the cooling liquid and was continuously accumulated as a filament on the inner wall of the revolving drum by centrifugal force. Diameter, degree of perfect circle, unevenness of size and amorphism of the resulted filaments are shown in Table 1. As is obvious from Table 1, the filaments in all cases were high quality amorphous metal filaments having a round cross-section of nearly a perfect circle and low unevenness of size in the longitudinal direction.

TABLE 1

| Example | Composition of alloy | Diameter of nozzle opening (μm) | Diameter of filament (μm) | Degree of perfect circle | Unevenness of size (%) | Diffraction of X-rays |
|---|---|---|---|---|---|---|
| 3 | $Fe_{75}$—$Si_{10}$—$B_{15}$ | 180 | 170 | 0.95 | 5.0 | Amorphism |
| 4 | $Fe_{77}$—$Si_5$—$B_{18}$ | " | " | 0.90 | 6.0 | " |
| 5 | $Fe_{80}$—$B_{20}$ | " | " | 0.94 | 5.5 | " |
| 6 | $Fe_{55}$—$Co_{20}$—$Si_{10}$—$B_{15}$ | " | " | 0.92 | 6.5 | " |
| 7 | $Fe_{65}$—$Ni_{10}$—$Si_{10}$—$B_{15}$ | " | " | 0.90 | 6.5 | " |
| 8 | $Fe_{70}$—$Cr_5$—$Si_{10}$—$B_{15}$ | " | " | 0.90 | 8.0 | " |
| 9 | $Fe_{70}$—$Mo_5$—$Si_{10}$—$B_{15}$ | " | " | 0.92 | 7.0 | " |
| 10 | $Fe_{72}$—$Nb_3$—$Si_{10}$—$B_{15}$ | " | " | 0.90 | 5.5 | " |
| 11 | $Fe_{72}$—$Ta_3$—$Si_{10}$—$B_{15}$ | " | " | 0.88 | 7.0 | " |
| 12 | $Fe_{72}$—$W_3$—$Si_{10}$—$B_{15}$ | " | " | 0.90 | 7.0 | " |
| 13 | $Fe_{72}$—$Mn_3$—$Si_{10}$—$B_{15}$ | " | " | 0.92 | 8.5 | " |
| 14 | $Fe_{72}$—$Ti_3$—$Si_{10}$—$B_{15}$ | " | " | 0.90 | 8.5 | " |
| 15 | $Fe_{72}$—$Zr_3$—$Si_{10}$—$B_{15}$ | " | " | 0.86 | 7.5 | " |
| 16 | $Fe_{72}$—$V_3$—$Si_{10}$—$B_{15}$ | " | " | 0.88 | 6.5 | " |
| 17 | $Fe_{72}$—$Al_3$—$Si_{10}$—$B_{15}$ | " | " | 0.88 | 5.5 | " |
| 18 | $Fe_{72}$—$Pd_3$—$Si_{10}$—$B_{15}$ | " | " | 0.90 | 6.0 | " |
| 19 | $Fe_{72}$—$Be_3$—$Si_{10}$—$B_{15}$ | " | " | 0.92 | 5.5 | " |
| 20 | $Fe_{72}$—$Au_3$—$Si_{10}$—$B_{15}$ | " | " | 0.94 | 6.0 | " |
| 21 | $Fe_{72}$—$Cu_3$—$Si_{10}$—$B_{15}$ | " | " | 0.92 | 6.5 | " |
| 22 | $Fe_{72}$—$Zn_3$—$Si_{10}$—$B_{15}$ | " | " | 0.90 | 7.0 | " |
| 23 | $Fe_{72}$—$Cd_3$—$Si_{10}$—$B_{15}$ | " | " | 0.91 | 7.0 | " |
| 24 | $Fe_{72}$—$Sn_3$—$Si_{10}$—$B_{15}$ | " | " | 0.93 | 6.5 | " |
| 25 | $Fe_{72}$—$As_3$—$Si_{10}$—$B_{15}$ | " | " | 0.92 | 5.5 | " |
| 26 | $Fe_{72}$—$Sb_3$—$Si_{10}$—$B_{15}$ | " | " | 0.93 | 5.5 | " |
| 27 | $Fe_{72}$—$Hf_3$—$Si_{10}$—$B_{15}$ | " | " | 0.87 | 7.0 | " |
| 28 | $Fe_{72}$—$Bi_3$—$Si_{10}$—$B_{15}$ | " | " | 0.88 | 6.0 | " |
| 29 | $Fe_{72}$—$P_3$—$Si_{10}$—$B_{15}$ | " | " | 0.92 | 7.0 | " |
| 30 | $Fe_{72}$—$C_3$—$Si_{10}$—$B_{15}$ | " | " | 0.94 | 5.5 | " |
| 31 | $Fe_{72}$—$Ge_3$—$Si_{10}$—$B_{15}$ | " | " | 0.90 | 8.0 | " |
| 32 | $Fe_{72}$—$S_3$—$Si_{10}$—$B_{15}$ | " | " | 0.90 | 7.0 | " |
| 33 | $Fe_{50}$—$Co_{20}$—$Cr_5$—$Si_{10}$—$B_{15}$ | " | " | 0.85 | 10.0 | " |

EXAMPLES 34–48

Spinning was carried out under the following conditions using the same apparatus as in Examples 3–33.

Composition of alloy: See Table 2

Fusing temperature: A temperature 70° C. higher than a melting point of each alloy (in argon atmosphere)

Diameter of nozzle opening: See Table 2

Jetting rate: 600 m/min.

Revolving rate of drum: 690 m/min.

Cooling liquid in revolving drum: A 20% aqueous solution of sodium chloride at −15° C.

Thickness of cooling liquid layer in revolving drum: 25 mm

Introduction angle to cooling liquid layer: 85°

Distance between nozzle and liquid surface of cooling liquid: 5 mm

Diameter, degree of perfect circle, unevenness of size and amorphism of the resulted filaments are shown in Table 2. As is obvious from Table 2, continuous amorphous metal filaments having a round cross-section were obtained under all tested conditions. Particularly, under nozzle conditions satisfying the formula (I) (namely, Examples 36–38, 40–43 and 46–48), high quality filaments having excellent degree of perfect circle and unevenness of size in the longitudinal direction were obtained.

TABLE 2

| Example | Composition of alloy | Diameter of nozzle opening (μm) | Diameter of filament (μm) | Degree of perfect circle | Unevenness of size (%) | Diffraction of X-rays |
|---|---|---|---|---|---|---|
| 34 | $Fe_{65}$—$Co_{10}$—$Si_6$—$B_{19}$ | 220 | 200 | 0.75 | 14.5 | Amorphism |
| 35 | " | 200 | 180 | 0.84 | 12.0 | " |
| 36 | " | 180 | 160 | 0.93 | 5.5 | " |
| 37 | " | 160 | 150 | 0.95 | 3.5 | " |
| 38 | " | 140 | 130 | 0.97 | 2.0 | " |
| 39 | $Fe_{70}$—$Ni_5$—$Si_{12}$—$B_{13}$ | 250 | 235 | 0.75 | 15.0 | Amorphism |
| 40 | " | 220 | 200 | 0.90 | 7.0 | " |
| 41 | " | 200 | 190 | 0.92 | 5.5 | " |
| 42 | " | 180 | 170 | 0.96 | 4.0 | " |
| 43 | " | 150 | 150 | 0.98 | 2.5 | " |
| 44 | $Fe_{71}$—$Cr_{10}$—$Si_{10}$—$B_9$ | 150 | 130 | 0.70 | 16.0 | Amorphism |
| 45 | " | 130 | 110 | 0.85 | 13.5 | " |
| 46 | " | 120 | 100 | 0.88 | 9.5 | " |
| 47 | " | 100 | 90 | 0.94 | 6.5 | " |
| 48 | " | 50 | 45 | 0.98 | 3.0 | " |

EXAMPLE 49

When spinning was carried out with using an alloy having a composition of $Fe_{77.5}$-$Si_{10}$-$B_{12.5}$ under a condition of diameter of nozzle opening: 150 μm, argon gas:

3.5 kg/cm$^2$ gauge pressure, jetting rate: 430 m/minute, revolving rate of revolving drum: 480 m/minute, introduction angle: 60°, cooling liquid: water at 5° C., thickness of cooling liquid layer: 15 mm and distance between nozzle and liquid surface of cooling liquid: 7 mm, by means of the same apparatus as that in Examples 3–33, a high quality continuous amorphous metal filament which had a diameter of filament: 135 μm, a degree of perfect circle: 0.98, and unevenness of size in the longitudinal direction: 2.5% was obtained. This filament had excellent mechanical and thermal properties, namely, tensile strength: 320 kg/mm$^2$ and crystallization temperature: 500° C. When this filament was subjected to stretch processing by a diamond die to a diameter of 110 μm (namely, a drafting ratio of 34%), an amorphous metal filament having a very uniform outward appearance was obtained, and the tensile strength was improved to 400 kg/mm$^2$.

EXAMPLES 50–80

Spinning was carried out by the same process as in Examples 3–33 except that Fe-P-C alloy shown in Table 3 was used and the diameter of nozzle opening was 150 μm. As the result, amorphous continuous filaments having a round cross-section were obtained in all cases as shown in Table 3.

TABLE 3

| Example | Composition of alloy | Diameter of nozzle opening (μm) | Diameter of filament (μm) | Degree of perfect circle | Unevenness of size (%) | Diffraction of X-rays |
|---|---|---|---|---|---|---|
| 50 | $Fe_{76.5}—P_{12.5}—C_{11}$ | 150 | 140 | 0.95 | 4.0 | Amorphism |
| 51 | $Fe_{79.5}—P_{11.5}—C_9$ | " | " | 0.90 | 5.0 | " |
| 52 | $Fe_{76.5}—P_{6.5}—C_{17}$ | " | " | 0.94 | 5.5 | " |
| 53 | $Fe_{76.5}—P_{18.5}—C_5$ | " | " | 0.92 | 4.5 | " |
| 54 | $Fe_{57}—C_{20}—P_{13}—C_{10}$ | " | " | 0.90 | 5.5 | " |
| 55 | $Fe_{67}—Ni_{10}—P_{13}—C_{10}$ | " | " | 0.92 | 4.5 | " |
| 56 | $Fe_{72}—Cr_5—P_{13}—C_{10}$ | " | " | 0.92 | 4.0 | " |
| 57 | $Fe_{72}—W_5—P_{13}—C_{10}$ | " | " | 0.94 | 5.0 | " |
| 58 | $Fe_{72}—Mo_5—P_{13}—C_{10}$ | " | " | 0.93 | 6.0 | " |
| 59 | $Fe_{72}—Ta_5—P_{13}—C_{10}$ | " | " | 0.93 | 6.5 | " |
| 60 | $Fe_{72}—Nb_5—P_{13}—C_{10}$ | " | " | 0.91 | 8.0 | " |
| 61 | $Fe_{74}—Mn_3—P_{13}—C_{10}$ | " | " | 0.92 | 7.5 | " |
| 62 | $Fe_{74}—V_3—P_{13}—C_{10}$ | " | " | 0.92 | 6.5 | " |
| 63 | $Fe_{74}—Al_3—P_{13}—C_{10}$ | " | " | 0.90 | 7.0 | " |
| 64 | $Fe_{74}—Zr_3—P_{13}—C_{10}$ | " | " | 0.90 | 6.5 | " |
| 65 | $Fe_{74}—Ti_3—P_{13}—C_{10}$ | " | " | 0.92 | 7.0 | " |
| 66 | $Fe_{74}—Pd_3—P_{13}—C_{10}$ | " | " | 0.92 | 5.5 | " |
| 67 | $Fe_{74}—Be_3—P_{13}—C_{10}$ | " | " | 0.91 | 5.5 | " |
| 68 | $Fe_{74}—Au_3—P_{13}—C_{10}$ | " | " | 0.94 | 7.0 | " |
| 69 | $Fe_{74}—Cu_3—P_{13}—C_{10}$ | " | " | 0.93 | 8.5 | " |
| 70 | $Fe_{74}—As_3—P_{13}—C_{10}$ | " | " | 0.93 | 9.0 | " |
| 71 | $Fe_{74}—Zn_3—P_{13}—C_{10}$ | " | " | 0.92 | 10.0 | " |
| 72 | $Fe_{74}—Cd_3—P_{13}—C_{10}$ | " | " | 0.90 | 5.0 | " |
| 73 | $Fe_{74}—Sn_3—P_{13}—C_{10}$ | " | " | 0.92 | 8.0 | " |
| 74 | $Fe_{74}—Sb_3—P_{13}—C_{10}$ | " | " | 0.94 | 7.5 | " |
| 75 | $Fe_{74}—Hf_3—P_{13}—C_{10}$ | " | " | 0.92 | 6.0 | " |
| 76 | $Fe_{74}—Bi_3—P_{13}—C_{10}$ | " | " | 0.96 | 5.0 | " |
| 77 | $Fe_{74}—B_3—P_{13}—C_{10}$ | " | " | 0.94 | 5.0 | " |
| 78 | $Fe_{74}—Si_3—P_{13}—C_{10}$ | " | " | 0.92 | 6.5 | " |
| 79 | $Fe_{74}—Ge_3—P_{13}—C_{10}$ | " | " | 0.90 | 8.0 | " |
| 80 | $Fe_{74}—S_3—P_{13}—C_{10}$ | " | " | 0.90 | 7.5 | " |

EXAMPLES 81–90

Spinning was carried out under the same condition as that in Examples 34–48, except that the composition of alloy and the diameter of nozzle opening were those shown in Table 4.

As is obvious from results shown in Table 4, amorphous metal filaments having a round cross-section were obtained in all cases. Particularly, filaments obtained under nozzle conditions satisfying the formula (II) (namely, Examples 83–85 and 88–90) were high quality filaments wherein the degree of perfect circle and the unevenness of size in the longitudinal direction were superior.

TABLE 4

| Example | Composition of alloy | Diameter of nozzle opening (μm) | Diameter of filament (μm) | Degree of perfect circle | Unevenness of size (%) | Diffraction of X-rays |
|---|---|---|---|---|---|---|
| 81 | $Fe_{70.5}—Co_{10}—P_{12.5}—C_7$ | 200 | 170 | 0.70 | 15.0 | Amorphism |
| 82 | " | 180 | 165 | 0.82 | 12.0 | " |
| 83 | " | 150 | 140 | 0.95 | 7.5 | " |
| 84 | " | 100 | 95 | 0.96 | 5.0 | " |
| 85 | " | 70 | 65 | 0.97 | 3.0 | " |
| 86 | $Fe_{50.5}—Ni_{16}—Cr_{10}—P_{12.5}—C_{11}$ | 280 | 260 | 0.75 | 14.5 | Amorphism |
| 87 | " | 260 | 250 | 0.84 | 11.5 | " |
| 88 | " | 250 | 230 | 0.92 | 6.5 | " |
| 89 | " | 200 | 180 | 0.97 | 4.5 | " |
| 90 | " | 150 | 145 | 0.97 | 2.5 | " |

EXAMPLES 91-95 AND COMPARATIVE EXAMPLES 1-3

Spinning was carried out using an alloy having a composition of $Fe_{76.5}$-$P_{12.5}$-$C_{11}$ by means of the same apparatus as that in Examples 3-33 under a condition namely, diameter of nozzle opening: 150 μm, jetting rate of metal alloy: 400 m/minute, introduction angle: 40°, cooling liquid: water at 10° C., thickness of cooling liquid layer: 10 mm and distance between nozzle and liquid surface of cooling liquid: 8 mm, but the rate of revolution of the drum was varied as shown in Table 5. As a result, continuous filaments could not be obtained in case that the revolving rate of drum was lower than the jetting rate (Comparative Examples 1-3), as shown in Table 5. On the contrary, in the case wherein the revolving rate of drum was higher than the jetting rate, amorphous metal filaments having a round cross-section could be obtained (Examples 91-95). Particularly, in the case wherein the rate was from 5 to 30% higher (Examples 92-94), the quality of the filaments was most excellent.

TABLE 5

| | Jetting rate (m/min.) | Revolving rate of drum (m/min.) | Rate increasing ratio* (%) | Diameter of filament (μm) | Degree of perfect circle | Unevenness of size (%) | Diffraction of X-rays |
|---|---|---|---|---|---|---|---|
| Comparative Example 1 | 400 | 300 | −50 | 170** | 0.28 | 230.0 | — |
| Comparative Example 2 | " | 340 | −15 | 160** | 0.47 | 110.0 | — |
| Comparative Example 3 | " | 380 | −5 | 155** | 0.55 | 41.0 | — |
| Example 91 | " | 400 | 0 | 150 | 0.85 | 9.0 | Amorphism |
| Example 92 | " | 420 | +5 | 145 | 0.93 | 5.0 | " |
| Example 93 | " | 440 | +10 | 140 | 0.94 | 4.5 | " |
| Example 94 | " | 520 | +30 | 130 | 0.94 | 5.0 | " |
| Example 95 | " | 600 | +50 | 125 | 0.86 | 7.0 | " |

*Increasing ratio of revolving rate of drum to jetting rate (%)
**In all cases, uneven fibrous product, not fine filament.

EXAMPLES 96-100

Spinning was carried out under the general conditions of Example 93, while maintaining a ratio of the rate of jetting to the rate of revolution of the drum at an increasing ratio of 10%, but both rates were varied as shown in Table 6. As the result, amorphous metal filaments having a round cross-section were obtained in all cases, as shown in Table 6, but qualities such as the degree of perfect circle, etc., of the filaments were more excellent in the cases when the rates were higher.

TABLE 6

| Example | Jetting rate (m/min.) | Revolving rate of drum (m/min.) | Rate increasing ratio (%) | Diameter of filament (μm) | Degree of perfect circle | Unevenness of size | Diffraction of X-rays |
|---|---|---|---|---|---|---|---|
| 96 | 100 | 110 | +10 | 140 | 0.86 | 10.5 | Amorphism |
| 97 | 250 | 275 | " | " | 0.93 | 9.0 | " |
| 98 | 300 | 330 | " | " | 0.95 | 5.0 | " |
| 99 | 500 | 550 | " | " | 0.97 | 4.5 | " |
| 100 | 600 | 660 | " | " | 0.97 | 4.0 | " |

COMPARATIVE EXAMPLES 4-8

Spinning was carried out under the same conditions as in Comparative Examples 1-3, except that the rate conditions such as jetting rate and revolving rate were increased as shown in the Table 7. As the result, only asymmetric short filaments were obtained in all cases, a continuous symmetric filament having a high degree of roundness and no an unevenness of size in the longitudinal direction as desired in this invention could not be obtained.

TABLE 7

| Comparative Example | Jetting rate (m/min.) | Revolving rate of drum (m/min.) | Rate increasing ratio (%) | Diameter of filament (μm) | Degree of perfect circle | Unevenness of size |
|---|---|---|---|---|---|---|
| 4 | 250 | 200 | −20 | 165 | 0.32 | 150 |
| 5 | 300 | 270 | −10 | 160 | 0.38 | 80 |
| 6 | 400 | 360 | −10 | 160 | 0.41 | 62 |
| 7 | 400 | 380 | −5 | 155 | 0.55 | 42 |
| 8 | 500 | 450 | −10 | 160 | 0.47 | 35 |

While the invention has been described in detail and with reference to specific embodiments thereof, it will be apparent to one skilled in the art that various changes and modifications can be made therein without departing from the spirit and scope thereof.

What is claimed is:

1. An amorphous metal alloy filament having a substantially circular cross-section and containing iron, silicon and boron, characterized in that the filament consists of 17.5 atomic % or less of Si; 5 to 22.5 atomic % if B; 0 to 30 atomic % of at least one element selected from the group consisting of Co, Ni, Cr, Mo, Nb, Ta, V, W, Zr, Ti, Be, Mn, Sn, Hf, Al, Pd, Pt, Cu, Cd, As, Sb, Bi, P, C, Ge and S, wherein Co is 0 to 30 atomic %, Ni is 0 to 20 atomic %, each of Cr, Mo, Nb and Ta is 0 to 10 atomic % respectively, each of V, W, Zr, Ti, Be, Mn, Sn, Hf, Al, Pd, Pt, Cu, Cd, As and Sb is 0 to 5 atomic % respectively, and the total of at least one element selected from the group consisting of Bi, P, C, Ge, and S is 0 to 5 atmic %; the remainder being Fe and incidental impurities, and the sum of Si and B being from 20 to 32.5 atomic %, and in that the filament has an unevenness in size in the longitudinal direction of 15% or less.

2. A filament according to claim 1 wherein the amorphous metal alloy filament has an average diameter satisfying the formula (I)

$$Df \leqq 270 - 9(|Si - 10|) - 25(|B + Si/2 - 20|) \quad (I)$$

wherein Df represents the diameter of the filament (μm), Si represents the atomic % of Si in the alloy, and B represents the atomic % of B in the alloy.

3. An amorphous metal alloy filament as in claim 1, wherein the degree of perfect circle of the filament is at least 0.7.

4. An amorphous metal alloy filament as in claim 2, wherein the degree of perfect circle of the filament is at least 0.7.

5. An amorphous metal alloy filament having a substantially circular cross-section and containing iron, phosphorus and carbon, characterized in that the filament consists of 5 to 20 atomic % of P; 5 to 20 atomic % of C; 0 to 30 atomic % of at least one element selected from the group consisting of Co, Ni, Cr, W, Mo, Ta, Nb, Mn, V, Al, Zr, Ge, Cu, Pd, Hf, Sn, Ti, Pt, Cd, As, Sb, Si, B, Bi and S, wherein Co is 0 to 30 atomic %, Ni is 0 to 20 atomic %, each of Cr, W, Mo, Ta and Nb is 0 to 10 atomic %, respectively, each of Mn, V, Al, Zr, Ge, Cu, Pd, Hf, Sn, Ti, Pt, Cd, As and S is 0 to 5 atomic %, respectively, and the total of at least one element selected from the group consisting of Si, B, Bi and S is 0 to 5 atomic %; the remainder being Fe and incidental impurities, and the sum of P and C being from 17.5 to 30 atomic %, and in that the filament has an unevenness in size in the longitudinal direction of 15% or less.

6. A filament according to claim 5 wherein the amorphous metal alloy filament has an average diameter satisfying the formula (II)

$$Df \leqq 250 - 16(|P - 12.5|) - 25(|23.5 - P - C|) \quad (II)$$

wherein Df represents the diameter of a filament (μm), P represents the atomic % of P in alloy and C represents the atomic % of C in the alloy.

7. An amorphous metal alloy filament as in claim 6, wherein the degree of perfect circle of the filament is at least 0.7.

* * * * *